US009896805B2

(12) United States Patent
Timm et al.

(10) Patent No.: US 9,896,805 B2
(45) Date of Patent: Feb. 20, 2018

(54) DURABLE WET-PRESSED TISSUE

(71) Applicant: Kimberly-Clark Worldwide, Inc., Neenah, WI (US)

(72) Inventors: Jeffrey James Timm, Menasha, WI (US); Michael Alan Hermans, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 15/326,513

(22) PCT Filed: Aug. 27, 2014

(86) PCT No.: PCT/US2014/052834
§ 371 (c)(1),
(2) Date: Jan. 16, 2017

(87) PCT Pub. No.: WO2016/032450
PCT Pub. Date: Mar. 3, 2016

(65) Prior Publication Data
US 2017/0204568 A1 Jul. 20, 2017

(51) Int. Cl.
*D21H 27/00* (2006.01)
*D21H 27/40* (2006.01)

(52) U.S. Cl.
CPC ..... *D21H 27/005* (2013.01); *D21H 27/002* (2013.01); *D21H 27/40* (2013.01)

(58) Field of Classification Search
CPC .... D21H 27/005; D21H 27/002; D21H 27/40; D21H 27/00
USPC ..... 162/111, 134
See application file for complete search history.

(56) References Cited

U.S. PATENT DOCUMENTS

| | | | | |
|---|---|---|---|---|
| 5,635,028 | A * | 6/1997 | Vinson | B32B 29/06 162/111 |
| 5,932,068 | A | 8/1999 | Farrington, Jr. et al. | |
| 6,033,523 | A | 3/2000 | Dwiggins et al. | |
| 6,197,154 | B1 | 3/2001 | Chen et al. | |
| 6,365,000 | B1 | 4/2002 | Dwiggins et al. | |
| 6,497,789 | B1 | 12/2002 | Hermans et al. | |
| 6,709,548 | B2 | 3/2004 | Marinack et al. | |
| 6,827,819 | B2 | 12/2004 | Dwiggins et al. | |
| 7,416,637 | B2 | 8/2008 | Murray et al. | |
| 7,588,660 | B2 | 9/2009 | Edwards et al. | |
| 7,988,828 | B2 * | 8/2011 | Hermans | D21H 23/50 162/134 |
| 8,574,399 | B2 | 11/2013 | Hermans et al. | |
| 2001/0040015 | A1 | 11/2001 | Lee | |
| 2002/0189773 | A1 | 12/2002 | Marinack et al. | |
| 2012/0180815 | A1 | 7/2012 | Sumnicht et al. | |
| 2013/0029105 | A1 | 1/2013 | Miller et al. | |
| 2013/0029106 | A1 | 1/2013 | Lee et al. | |
| 2013/0068867 | A1 * | 3/2013 | Hermans | D21H 27/30 242/160.4 |
| 2013/0071655 | A1 * | 3/2013 | Zwick | D21H 27/002 428/340 |

FOREIGN PATENT DOCUMENTS

| | | | |
|---|---|---|---|
| EP | 1 985 754 | A2 | 10/2008 |
| JP | 2010-090489 | A | 4/2010 |

* cited by examiner

*Primary Examiner* — Mark Halpern
(74) *Attorney, Agent, or Firm* — Kimberly-Clark Worldwide, Inc.

(57) ABSTRACT

The disclosure provides a wet-pressed tissue product having improved cross-machine tensile, toughness and durability properties. Cross-machine properties are significant because tissue products often fail in the cross-machine direction because it is often the weaker of the two product orientations (cross and machine directions). Accordingly, in certain embodiments the present disclosure provides a conventional wet pressed tissue product having a CD Tensile greater than about 450 g/3" and a CD Stretch greater than about 6.0 percent.

13 Claims, 1 Drawing Sheet

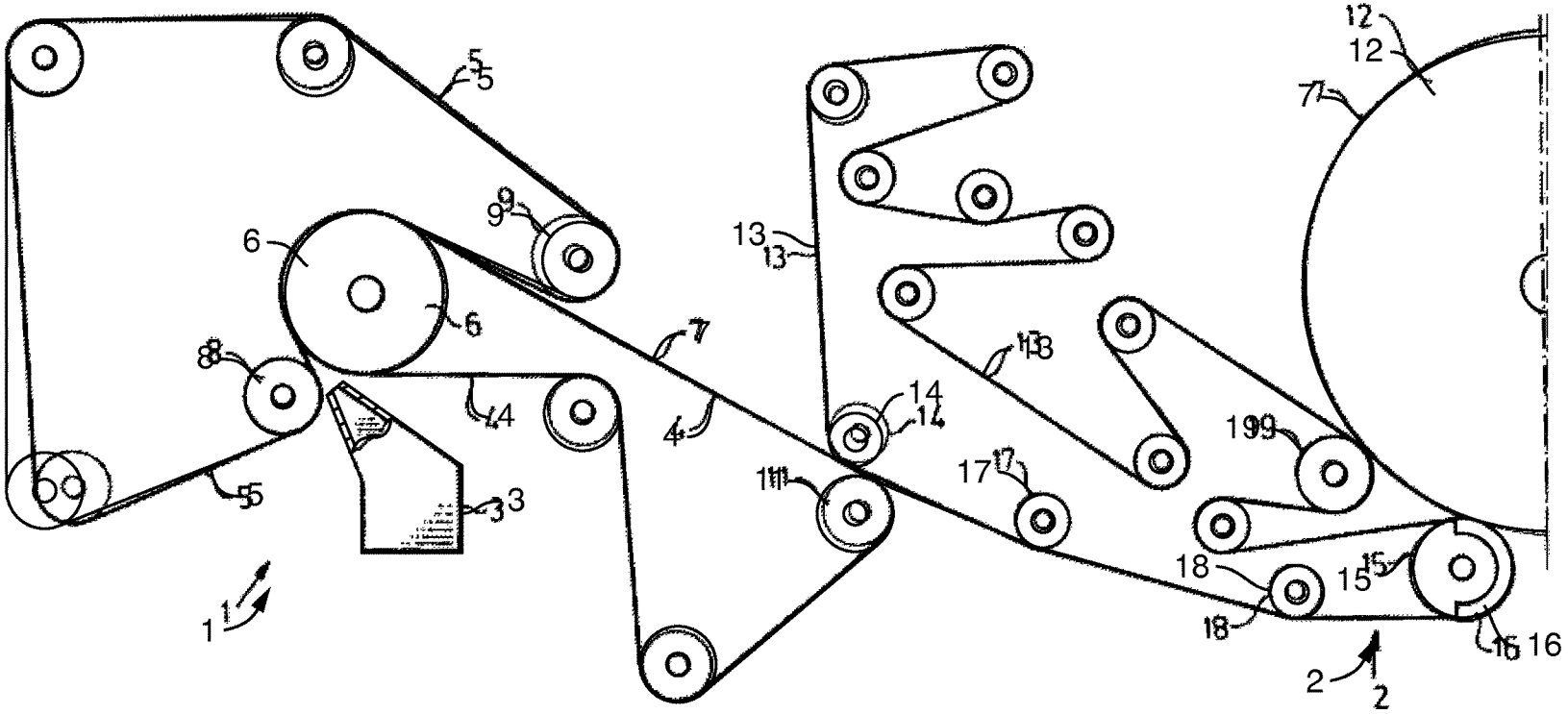
1
2
3
4
5
6
7
8
9
11
12
13
14
15
16
17
18
19

DURABLE WET-PRESSED TISSUE

This application is a 371 of PCT/US2014/052834 filed 27 Aug. 2014.

BACKGROUND OF THE DISCLOSURE

In the manufacture of tissue products, such as facial tissue, bath tissue, paper towels and the like, the tissue sheet is formed by depositing an aqueous suspension of papermaking fibers onto a forming fabric. The web is then transferred to a papermaking felt and dewatered as it passes through a pressure nip created between a pressure roll and a Yankee dryer as the wet web is transferred to the Yankee surface. Free water expressed from the web in the pressure nip is absorbed and carried away by the felt as the web transfers to the Yankee surface. The web is then final dried on the surface of the Yankee and subsequently creped to impart bulk and softness to the resulting tissue sheet. This method of making tissue sheets is commonly referred to as "wet-pressing" because of the method used to dewater the wet web.

The wet-pressing method has several distinct drawbacks. First, pressing the tissue web while wet densifies the web. Second, to restore a portion of the original web density it is necessary to crepe the web, which requires a large amount of energy to dry the web from a consistency of about 35 percent to a final dryness of about 95 percent. Third, because the web is densified by wet pressing immediately prior to drying, there is limited opportunity to impart structure to the web, which limits the tissuemaker's ability to modify the cross-machine direction properties of the web. As such, wet-pressed tissue products typically have only a modest degree of cross-machine direction stretch, relatively low cross-machine direction tensile energy absorption and modest degrees of durability and toughness in the cross-machine direction. These properties can be increased by increasing the cross-machine direction tensile strength, but in order to maximize product softness, the tensile strength must be limited to a reasonable level.

Therefore there is a need for a method of making wet-pressed tissue sheets having improved cross-machine direction properties, such as increased cross-machine direction stretch, increased cross-machine direction tensile energy absorption and increased degrees of durability and toughness in the cross-machine direction.

SUMMARY OF THE DISCLOSURE

The present disclosure provides wet-pressed tissue product having improved product properties and more particularly improved cross-machine tensile, toughness and durability properties. Cross-machine properties are significant because tissue products often fail in the cross-machine direction because it is often the weaker of the two product orientations (cross and machine directions). Accordingly, in certain embodiments the present disclosure provides a conventional wet pressed tissue product having a CD Tensile greater than about 450 g/3" and a CD Stretch greater than about 6.0 percent.

In other embodiments the present disclosure provides a method of producing a tissue product having improved CD properties, the method comprising the steps of dispersing cellulosic fibers having a curl index less than about 0.10 to form a first fibrous slurry, dispersing curled cellulosic fibers having a curl index greater than about 0.20 to form a second fibrous slurry, pumping the first and second fibrous slurries to a multi-channel headbox, depositing the first and second fibrous slurries from the multi-channel headbox onto a foraminous surface to form a multi-layered fibrous web, pressing the multi-layered fibrous web against a felt to form a partially dewatered web having a consistency from about 40 to about 50 percent, adhering the partially dewatered web against a Yankee dryer, drying the web to a consistency of greater than about 90 percent and creping the dried web to remove it from the Yankee dryer, the resulting web having a CD Tensile greater than about 450 g/3" and a CD Stretch greater than about 6.0 percent.

In other embodiments the present disclosure provides a wet pressed tissue product having a basis weight from about 16 to about 20 grams per square meter (gsm), a CD Stretch greater than about 6.0 percent, such as from about 6.0 to about 8.0 percent, and CD Tensile greater than about 450 g/3", such as from about 450 to about 800 g/3".

In yet other embodiments the present disclosure provides a conventional wet pressed tissue product having a CD Stretch greater than about 6.0 percent, such as from about 6.0 to about 8.0, and CD TEA greater than about 4.0 $g*cm/cm^2$, such as from about 4.0 to about 6.0 $g*cm/cm^2$.

In still other embodiments the present disclosure provides a conventional wet pressed tissue product having a CD Tensile greater than about 450 g/3", such as from about 450 to about 800 g/3", and a CD Durability Index greater than about 18.0.

In other embodiments the present disclosure provides a single ply conventional wet pressed tissue product having a basis weight from about 16 to about 20 gsm, a CD Stretch from about 6.0 to about 8.0 percent, a CD Tensile strength from about 450 to about 800 g/3" and a CD Tear from about 8.0 to about 11.0 gf.

In yet other embodiments the present disclosure provides a single ply conventional wet pressed tissue product having a basis weight from about 16 to about 20 gsm, a CD Stretch from about 6.0 to about 8.0 percent and a CD Tensile strength from about 450 to about 800 g/3".

In other embodiments the present disclosure provides a conventional wet pressed tissue product comprising at least about 10 percent, by weight of the tissue product, curled fibers, the tissue product having a CD Stretch greater than about 6.0 percent and CD Tensile greater than about 450 g/3".

In yet other embodiments the present disclosure provides a conventional wet pressed tissue product comprising a first and a second layer, wherein the second layer comprises at least about 10 percent, by weight of the tissue product, curled fibers and the first layer is substantially free from curled fibers, the tissue product having a CD Stretch greater than about 6.0 percent and CD Tensile greater than about 450 g/3".

BRIEF DESCRIPTION OF DRAWINGS

FIG. 1 is a schematic illustration of a wet-pressed tissue making process suitable for purposes of this invention.

DETAILED DESCRIPTION OF THE DISCLOSURE

As used herein the term "wet-pressed tissue" generally refers to a tissue product manufactured by a conventional wet-pressed method in which prior to the nascent tissue web being transferred to the surface of a rotating drying cylinder, such as a Yankee dryer, water is expressed from the web and absorbed by a felt. The dewatered web, typically having a consistency of about 40 percent, is then dried while on the hot surface of the dryer. The web is then creped from the surface of the dryer.

As used herein the term "curl index" generally refers to the length weighed curl index determined using an OpTest Fiber Quality Analyzer (FQA) from OpTest Equipment, Hawkesbury, Ontario, Canada, Model No. Code LDA 96

As used herein, a "tissue product" generally refers to various paper products, such as facial tissue, bath tissue, paper towels, napkins, and the like.

The term "ply" refers to a discrete product element. Individual plies may be arranged in juxtaposition to each other. The term may refer to a plurality of web-like components such as in a multi-ply tissue product, such as a multi-ply facial tissue, bath tissue, paper towel, wipe, or napkin.

As used herein, the term "layer" refers to a plurality of strata of fibers, chemical treatments, or the like, within a ply.

As used herein, the term "machine direction (MD) tensile strength" is the peak load per 3 inches of sample width when a sample is pulled to rupture in the machine direction. Similarly, the "cross-machine direction (CD) tensile strength" is the peak load per 3 inches of sample width when a sample is pulled to rupture in the cross-machine direction. The percent elongation of the sample prior to breaking is the "stretch" and may be specified according to the orientation of the sample as either "MD stretch" or "CD stretch". The MD tensile strength, CD tensile strength and stretch are in the course of determining tensile strength as described in the Test Methods section.

As used herein the term "geometric mean tensile" (GMT) refers to the square root of the product of the MD tensile strength and CD tensile strength of the web, which are measured as described in the Test Methods section.

As used herein the term "slope" refers to slope of the line resulting from plotting tensile versus stretch and is an output of the MTS TestWorks™ in the course of determining the tensile strength as described in the Test Methods section. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams per 3 inch sample width.

As used herein the term "TEA" refers to the tensile energy absorption and is calculated as the area under the stress-strain curve. TEA is an output of the MTS TestWorks™ in the course of determining the tensile strength as described in the Test Methods section.

As used herein the term "CD Durability Index" generally refers to the ability of a tissue product to resist failure in the cross-machine direction in use and is calculated by adding CD Stretch (having units of percent), CD TEA (having units of g*cm/cm$^2$) and CD Tear (having units of gf) according to the formula:

$$CD\ \text{Durability} = CD\ \text{Tear}\ (gf) + CD\ \text{Stretch}\ (\%) + CD\ TEA\ (g{*}cm/cm^2)$$

The strength of tissue products is often measured as the geometric mean tensile strength (GMT), which takes into account the machine direction (MD) tensile strength and the cross-machine direction (CD) tensile strength. However, using a single strength value to characterize a sheet can be misleading because the MD and CD tensile strength values are typically very different, with the MD tensile strength being much greater than the CD tensile strength. In use, the product is more likely to fail because its strength is limited by the weakest link, namely the CD tensile strength. In response, some prior emphasis has been made on making products in which the MD and CD tensile strengths of the sheets are the same, thereby eliminating sheet failure caused by a relatively weak CD tensile strength. However, focusing on tensile strength alone ignores the key role that other properties play in the consumer's perception of strength.

It has now been discovered that the perceived in-use strength of wet-pressed tissue products can be improved by providing the product with a significant level of stretch, particularly in the CD direction of the sheet, at a given tensile strength. Having improved stretch at a given tensile strength, the tissue products of the present disclosure also have improved TEA, and in particular improved CD TEA. The improvement in CD TEA in combination with improved CD stretch provides a tissue product with improved cross-machine durability and toughness.

In certain embodiments the improvement in CD properties is achieved by forming a wet pressed tissue from a fiber furnish comprising curled fibers. Curled fibers are known in the art and have been used previously to form tissue webs, such as described in U.S. Pat. No. 5,501,768 to Hermans et al., the contents of which are incorporated herein in a manner consistent with the present disclosure. Curling fibers introduces highly localized compressive strain to the fiber wall causing delamination. The delamination of the fiber wall causes structural changes in the fiber, often referred to as kinks or crimps, which cause the fiber axis to change abruptly and for the fiber to become curly. While deformations such as crimps or kinks increase the stretch-potential of fibers, they decrease the tensile strength. This is because the deformations result in a fiber network with uneven stress distribution, leading to stress concentration, and premature sheet failure. Surprisingly, however, applicants have demonstrated a wet pressed tissue product comprising curled fibers, which has improved CD stretch, without a decrease in CD tensile.

The surprising increase in CD stretch without a corresponding decrease in CD tensile strength is not found in prior art wet pressed tissue products. With reference to Table 1, below, tissue products of the present disclosure generally have improved CD Stretch and CD TEA at a given CD Tensile strength compared to commercially available wet pressed tissue products.

TABLE 1

| Product | Plies | Basis Wt. (gsm) | CD Tensile (g/3") | CD Stretch (%) | CD TEA (g*cm/cm$^2$) | 1000 × CD TEA / CD Tensile | 100 × CD Stretch / CD Tensile |
|---|---|---|---|---|---|---|---|
| Marcal ™ 1000 | 1 | 17.7 | 534 | 4.7 | 3.44 | 6.44 | 0.88 |
| Kroger ™ 1000 | 1 | 18.2 | 425 | 4.2 | 3.14 | 7.39 | 0.99 |
| Ology ™ 1000 | 1 | 18.2 | 369 | 5.0 | 2.65 | 7.18 | 1.36 |
| Scott ™ 1000 | 1 | 17.0 | 582 | 5.1 | 4.29 | 7.37 | 0.88 |
| Great Value ™ 1000 | 1 | 16.7 | 458 | 4.4 | 3.04 | 6.64 | 0.96 |
| Inventive | 1 | 18.0 | 521 | 6.2 | 4.64 | 8.91 | 1.19 |
| Inventive | 1 | 18.0 | 619 | 6.4 | 4.96 | 8.01 | 1.04 |

Accordingly, in certain embodiments tissue products prepared according to the present disclosure generally comprise a single ply and are manufactured by a conventional wet pressed process. The tissue products generally have a basis weight greater than about 10 grams per square meter ("gsm"), for example from about 10 to about 40 gsm and more specifically from about 15 to about 35 gsm. In certain embodiments the present disclosure provides a single ply wet pressed tissue product having a basis weight from about 10 to about 20 gsm, such as from about 15 to about 18 gsm.

At the foregoing basis weights tissue products prepared according to the present disclosure have geometric mean tensile (GMT) strengths greater than about 450 g/3", such as from about 450 to about 800 g/3" and more specifically from about 500 to about 700 g/3".

In certain embodiments, wet pressed tissue products made according to the present disclosure may have CD Stretch greater than about 6.0 percent, such as from about 6.0 to about 10.0 percent and more specifically from about 7.0 to about 9.0 percent. Generally, at the foregoing levels of CD Stretch the tissue products also have relatively high CD tensile strength, such as greater than about 450 g/3", such as from about 450 to about 800 g/3" and more specifically from about 500 to about 700 g/3". In a particularly preferred embodiment the tissue products have a CD Stretch from about 6.0 to about 8.0 percent and a CD tensile strength from about 500 to about 700 g/3". At these levels of CD tensile strength and CD stretch the tissue products of the present disclosure are highly durable, particularly in what is generally the weakest orientation of the tissue product—the cross machine direction. Accordingly, tissue products of the present disclosure generally withstand use better than prior art tissue products; particularly single ply wet pressed tissue products.

In addition to having improved CD Stretch at a given CD tensile strength the wet pressed tissue products disclosed herein may also have improved CD TEA. For example, in certain embodiments the wet pressed tissue products may have a CD TEA greater than about 4.0 g*cm/cm$^2$, such as from about 4.0 to about 6.0 g*cm/cm$^2$ and more specifically from about 4.0 to about 5.0 g*cm/cm$^2$. In one particularly preferred embodiment the present disclosure provides a single ply wet pressed tissue having a CD Stretch from about 6.0 to about 8.0 percent, a CD tensile strength from about 450 to about 600 g/3" and a CD TEA greater than about 4.0 g*cm/cm$^2$.

In addition to having improved CD tensile properties, such as tensile strength, stretch and tensile energy absorption, in other embodiments, the wet pressed tissue products of the present disclosure may also have improved CD Tear strength. The improvements in CD Tear strength further contributes to the overall improvement in the toughness and durability of the tissue product. For example, in one embodiment the tissue products have a CD Tear greater than about 8.0 gf, such as from about 8.0 to about 11.0 gf and more specifically from about 9.0 to about 10.0 gf.

The improvements to the cross-machine direction properties, such as tensile strength, stretch and tensile energy absorption generally yield a tissue product having improved durability and toughness that holds up better in-use compared to other wet pressed tissue products. Accordingly, in certain embodiments the present disclosure provides a wet pressed tissue product having CD Durability Index greater than about 18.0, such as from about 18.0 to about 22.0 and more specifically from about 20.0 to about 22.0. In one particularly preferred embodiment the present disclosure provides a single ply wet pressed tissue product having a basis weight from about 16 to about 20 gsm, a CD Tensile strength from about 450 to about 600 g/3" and a CD Durability Index greater than about 20.0.

In addition to having improved cross-machine direction properties, tissue products prepared according to the present disclosure also have relatively low slough, such as less than about 4.0 mg, and still more preferably less than about 3.5 mg, such as from about 3.0 to about 4.0 mg. For example, in certain embodiments the present disclosure provides a conventional wet pressed tissue product having a CD Durability Index greater than about 18.0 and a slough from about 3.0 to about 4.0 mg.

Moreover, the relatively low sloughs are achieved at relatively modest geometric mean tensile strengths. This provides a tissue having the requisite softness and stiffness, without excessive pilling. For example, creped tissue products prepared according to the present disclosure have geometric mean tensile strengths of less than about 1000 g/3", and more preferably less than about 900 g/3", and still more preferably less than about 800 g/3", such as from about 450 to about 800 g/3".

Generally the base webs and tissue products of the present disclosure are prepared by a conventional wet pressed tissue manufacture, such as that illustrated in FIG. 1. The paper machine shown is a twin wire machine comprising a wet end 1 and a dry section 2. The wet end includes a headbox 3, a movable carrying forming wire 4, a movable covering forming wire 5 and a forming roll 6 which may be perforated and provided with suction means. Alternatively, the forming roll may be smooth. The headbox 3 supplies a single or multi-layer flow of stock between the two moving forming wires 4, 5 for forming a paper web 7 by dewatering the stock. The two forming wires 4, 5 run together over the forming roll 6 and then in individual loops over a plurality of rolls arranged to impel, guide, align and stretch the carrying forming wire 4 and the covering forming wire 5. The rolls defining the path of the covering forming wire 5 include a breast roll 8 and, a short way after the forming roll 6, a guide roll 9 which can be termed a forward drive roll. The covering forming wire 5 leaves the carrying forming wire 4 and the paper web 7 either immediately before the wire 4 and paper web 7 diverge from the forming roll 6, or at a transfer suction box, not shown, or other transfer means located between forming roll 6 and forward drive roll 9. The carrying forming wire 4 runs to the drying section 2 where it leaves the paper web 7 by changing its direction of travel around a guide roll 11.

The drying section 2 comprises a Yankee dryer 12 having a relatively large diameter and a polished cylindrical surface. The Yankee dryer 12, preferably consisting of a cylinder covered by a hood (not shown), in which hot air is blown at high speed against the paper web 7. The paper web is creped from the Yankee dryer 12 by means of a creping doctor (not shown) to obtain the desired creping, after which the finished creped paper web is wound onto a roll. Further, the drying section 2 includes a felt 13 disposed upstream of the Yankee dryer 12 and travelling in a loop around several rolls and around a pick-up means, suitably in the form of a roll 14, located nearest the wet end 1 and thereby in the vicinity of said guide roll 11 for the carrying forming wire 4, and a press roll 15 which presses against the Yankee dryer 12 and is provided with suction means 16 to dewater the paper web before the latter comes into contact with the Yankee dryer 12. The pick-up means may alternatively consist of a shoe. Further, two guide rolls 17, 18 are disposed between the pick-up roll 14 and press roll 15, said guide rolls 17, 18 deflecting with a small angle the direction of travel of the felt 13. A blind-drilled roll 19 is disposed after the press roll 15, in contact with Yankee dryer. The paper web 7 is transferred to the felt 13 at the point where this and the carrying forming wire 4 converge at the pick-up roll 14 and thereafter immediately diverge from each other. Suitable conditioning means (not shown) are disposed along the loop of the felt 13 in order to condition the felt prior to contact with the paper web.

As described above the web is mechanically dewatered by a compression nip while the wet web is in contact with a papermaking felt and thereafter dried with the aid of a Yankee dryer. As used herein, a "felt" is an absorbent papermaking fabric designed to absorb water and remove it from a tissue web. Papermaking felts of various designs are well known in the art. The water expressed from the wet web during compression is absorbed and carried away by the felt. Commonly, the compression nip is formed between a press roll and the surface of the Yankee dryer. Particularly suitable wet-pressed tissue products in accordance with this invention are mechanically dewatered, final-dried on a Yankee dryer and once-creped.

Preferably the formed web is dried by transfer to the surface of a rotatable heated dryer drum, such as a Yankee dryer. In accordance with the present disclosure, the creping composition may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade. Creping the web, as it is formed, further reduces internal bonding within the web and increases softness. Applying the creping composition to the web during creping, on the other hand, may increase the strength of the web.

In a particularly preferred embodiment the formed web is transferred to the surface of the Yankee dryer by a suction pressure roll. Particularly suitable press loads for purposes of this invention can have a peak pressure of about 1.4 MPa or greater, more specifically from about 4 to about 8 MPa, and still more specifically from about 4 to about 6 MPa. The wet tissue web can be dewatered to a consistency of about 30 percent or greater, more specifically about 40 percent or greater, more specifically from about 40 to about 50 percent, and still more specifically from about 45 to about 50 percent. As used herein and well understood in the art, "consistency" refers to the bone dry weight percent of the web based on fiber.

In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web.

Generally papermaking fibers useful for purposes of this invention include any cellulosic fibers which are known to be useful for making paper, particularly those fibers useful for making relatively low density tissue papers such as facial tissue, bath tissue, dinner napkins, paper towels, and the like. The most common papermaking fibers include virgin softwood and hardwood fibers, as well as secondary or recycled cellulosic fibers. As used herein, "secondary fiber" means any cellulosic fiber which has previously been isolated from its original matrix via physical, chemical or mechanical means and, further, has been formed into a fiber web, dried to a moisture content of about 10 weight percent or less and subsequently isolated from its web matrix by some physical, chemical, or mechanical means. Fibers which have been passed through a shaft disperser as described herein are sometimes referred to as "dispersed fibers" or "curled fibers."

In one particularly preferred embodiment to increase the durability, and more specifically the cross-machine direction durability, of a tissue product the present disclosure may utilize a papermaking furnish comprising curled fiber, also sometimes referred to in the art as "dispersed fibers." Papermaking fibers, such as those described above, may be curled by chemically treating the papermaking fibers or by mechanically treating papermaking fibers. Methods of curling fibers are well known in the art and include, for example, methods disclosed in U.S. Pat. No. 2,516,384 to Hill et al.; U.S. Pat. No. 3,382,140 to Henderson et al.; U.S. Pat. No. 4,036,679 to Bach et al.; U.S. Pat. No. 4,431,479 to Barbe et al.; U.S. Pat. No. 5,384,012 to Hazard; U.S. Pat. No. 5,348,620 to Hermans et al.; U.S. Pat. No. 5,501,768 to Hermans et al.; or U.S. Pat. No. 5,858,021 to Sun et al., all of which are incorporated herein in a manner consistent with the present disclosure.

In many embodiments, curled fibers useful in the present disclosure have a curl index that is at least about 30 percent higher than the curl index of the fiber prior to the step of concurrently heat treating and convolving the fiber. It is preferred that the curl index of the treated fiber is durable enough so that it is reduced by at most about 25 percent by treatment at 1 percent consistency at 125° F. in a disintegrator for 30 minutes. More preferably, the curl index of the treated fiber is reduced by at most about 15 percent by treatment at 1 percent consistency at 125° F. in a disintegrator for 30 minutes. In particularly preferred embodiments of the present disclosure, the curl index of the treated fiber is at least about 40 percent higher than the curl index of the fiber prior to heat treating and convolving the fiber in accordance with the present disclosure. Still more preferably the treated fiber has a curl index of at least about 50 percent higher than the curl index of the fiber prior to treatment.

The curl index attained by way of practicing the present disclosure will to some extent depend upon the curl index of the fiber prior to treatment. In most cases, the treated fiber has a curl index greater than about 0.12. More preferably the curled fiber has a curl index greater than about 0.15 and still more preferably greater than about 0.20, such as from about 0.20 to about 0.30.

In certain embodiments the tissue product may comprise from about 5 to about 80 percent, by weight of the tissue product, curled fibers. In a particularly preferred embodiment the tissue product may comprises at least about 10 percent by weight curled fibers, such as from about 10 to about 80 weight percent, and more preferably from about 10 to about 50 percent by weight curled fibers.

In one particularly preferred embodiment of the present disclosure, the tissue product comprises a single-ply product having three-layers where curled fibers are selectively incorporated into the "felt side" and "dryer side" of the tissue web. (The "felt side" refers to the side of the tissue in contact with the felt during dewatering, while the "dryer side" refers to the opposite side of the tissue which is in contact with the Yankee dryer.) The center of the tissue preferably comprises ordinary softwood fibers or secondary fibers, which have not been curled. However, it is within the scope of this invention to include curled fibers in all layers. For a two-ply product, it is preferred to provide curled fibers on the dryer side of the tissue sheet and ply the two tissue sheets together such that the curled fiber layers become the outwardly facing surfaces of the product. Nevertheless, the curled fibers (virgin fibers or secondary fibers) can be present in any or all layers depending upon the sheet properties desired. In all cases the presence of curled fibers can increases CD stretch at a given CD tensile and improves cross-machine direction durability and toughness. The amount of curled fibers in any layer can be any amount from 10 to about 100 weight percent, more specifically about 33 weight percent or greater, about 50 weight percent or greater, or about 75 weight percent or greater.

Test Methods

All samples are conditioned in accordance with TAPPI test method T402 sp-03 "Standard Conditioning and Testing Atmosphere For Paper, Board, Pulp Handsheets and Related Products" before performing the test methods described below.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue basesheet such that the test specimen measures 63 mm±0.15 mm (2.5 inches±0.006 inch) in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the proscribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single ply basesheet. This is done by multiplying the single ply basesheet tear value by the number of plies in the finished product Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Tensile

The procedure for measuring tensile strength and stretch is as follows. Samples for tensile strength testing are prepared by cutting a 3 inches (76.2 mm) wide by 4 inches (102 mm) long strip in either the machine direction (MD) or cross-machine direction (CD) orientation using a JDC Precision Sample Cutter (e.g. Thwing-Albert Instrument Company, Philadelphia, Pa., Model No. JDC 3-10 or equivalent). The instrument used for measuring tensile strengths is a Constant-Rate-of-Extension (CRE) tensile tester (e.g. MTS Sintech 500/S or equivalent). The data acquisition software is MTS TestWorks® for Windows Ver. 4.08B from MTS Systems Corporation, Eden Prairie, Minn. The load cell is 50 Newtons from MTS Systems Corporation such that the majority of peak load values fall between 10 to 90 percent of the load cell's full scale value. The gauge length between jaws is 2+/−0.04 inches (51+/−1 mm). The jaws are operated using pneumatic-action and are rubber coated. The minimum grip face width is 3 inches (76.2 mm), and the approximate height of a jaw is 0.5 inches (12.7 mm). The rate of separation of the jaws is 10+/−0.4 inches/min (254+/−10 mm/min). The preload preferably is less than 15 grams with 25 grams as the maximum allowable preload. The sample is placed in the jaws of the instrument, centered both vertically and horizontally. The test is then started and ends when the specimen breaks. The peak load is recorded as either the "MD tensile strength" or the "CD tensile strength" of the specimen depending on direction of the sample being tested. At least ten (10) representative specimens are tested for each tissue sheet and the arithmetic average of all individual specimen tests is either the MD or CD tensile strength for the tissue.

Basis Weight

The bone dry weight of the sample is determined by placing the sample in a commercial oven (e.g. Blue M Industrial Ovens serial #10089811 from Thermal Product Solutions or equivalent) and maintained at 105±2° C. for 60±5 minutes before weighing. The resulting sheet bulk is expressed in cubic centimeters per gram (cc/g).

Caliper

Caliper is measured in accordance with TAPPI test method T411 om-89 "Thickness (caliper) of Paper, Paperboard, and Combined Board" with modifications to the size of the pressure foot and the amount of pressure applied to the sample. In particular, the micrometer used for carrying out the caliper measurement is an Emveco 200-A Electronic Microgage available from Emveco, Inc., Newberg, Oreg., having a circular pressure foot area of 2500 square millimeters and a diameter of 56.42 millimeters. The dwell time is 3 seconds, the lowering rate is 0.8 millimeters per second and the applied pressure is 2 kilo-Pascals.

Slough

Slough, also referred to as "pilling," is a tendency of a tissue sheet to shed fibers or clumps of fibers when rubbed or otherwise handled. The slough test provides a quantitative measure of the abrasion resistance of a tissue sample. More specifically, the test measures the resistance of a material to an abrasive action when the material is subjected to a horizontally reciprocating surface abrader. The equipment and method used is similar to that described in U.S. Pat. No. 6,808,595, the disclosure of which is herein incorporated by reference to the extent that it is non-contradictory herewith. The test apparatus comprises an abrading spindle or mandrel which consists of a stainless steel rod, 0.5" in diameter with the abrasive portion consisting of a 0.005" deep diamond pattern knurl extending 4.25" in length around the entire circumference of the rod. The abrading spindle is mounted perpendicularly to the face of the instrument such that the abrasive portion of the abrading spindle extends out its entire distance from the face of the instrument. On each side of the abrading spindle is located a pair of clamps, one movable and one fixed, spaced 4" apart and centered about the abrading spindle. The movable clamp (weighing approximately 102.7 grams) is allowed to slide freely in the vertical direction, the weight of the movable clamp providing the means for insuring a constant tension of the tissue sheet sample over the surface of the abrading spindle.

Prior to testing, all tissue sheet samples are conditioned at 23±1° C. and 50±2 percent relative humidity for a minimum of 4 hours. Using a JDC-3 or equivalent precision cutter, available from Thwing-Albert Instrument Company, Philadelphia, Pa., the tissue sheet sample specimens are cut into 3±0.05" wide×7" long strips (note: length is not critical as long as specimen can span distance so as to be inserted into the clamps). For tissue sheet samples, the MD direction corresponds to the longer dimension. Each tissue sheet sample is weighed to the nearest 0.1 mg. One end of the tissue sheet sample is clamped to the fixed clamp, the sample then loosely draped over the abrading spindle or mandrel and clamped into the sliding clamp. The entire width of the tissue sheet sample should be in contact with the abrading spindle. The sliding clamp is then allowed to fall providing constant tension across the abrading spindle.

The abrading spindle is then moved back and forth at an approximate 15 degree angle from the centered vertical centerline in a reciprocal horizontal motion against the tissue sheet sample for 20 cycles (each cycle is a back and forth stroke), at a speed of 170 cycles per minute, removing loose fibers from the surface of the tissue sheet sample. Additionally the spindle rotates counter clockwise (when looking at the front of the instrument) at an approximate speed of 5 RPMs. The tissue sheet sample is then removed from the jaws and any loose fibers on the surface of the tissue sheet sample are removed by gently shaking the tissue sheet sample. The tissue sheet sample is then weighed to the nearest 0.1 mg and the weight loss calculated. Ten tissue sheet specimens per sample are tested and the average weight loss value in milligrams (mg) is recorded, which is the Pilling value for the side of the tissue sheet being tested.

Examples

Conventional wet-pressed tissue products were produced substantially as illustrated in FIG. 1. The tissue product was a one-ply product having a basis weight of 18 grams per square meter (gsm). The furnished blend used to produce the tissue products comprised 30 percent Northern bleached softwood kraft ("NBSK") and 70 percent eucalyptus hardwood kraft ("EHWK"). In certain instances tissue products were produced by substituting a portion of the EHWK with curled EHWK fibers. The curled EHWK had a curl index of approximately 0.2 as determined via a Fiber Quality Analyzer (OpTest Equipment, Hawkesbury, Ontario, Canada, Model No. Code LDA 96).

The EHWK, NBSK and curled EHWK pulps were provided as dry lap pulps and were repulped separately as different pulping times were required. In certain instances the pulps were refined or wet end chemicals (FennoBond™ 3000, Kemira, Atlanta, Ga. and Starch) were added. When added, wet end chemicals were added to the middle layer of the three layer tissue base sheet. The Creping adhesive was a mixture of polyvinyl alcohol, water and Kymene®. The crepe ratio was set at 1.20-1.25. The control and experimental codes produced are shown below.

TABLE 2

| Code | NBSK (wt %) | EHWK (wt %) | Curled EHWK (wt %) | FennoBond ™ 3000 (kg/MT) | Starch (kg/MT) | NBSK Refining (minutes) |
|---|---|---|---|---|---|---|
| Control 1 | 30 | 70 | 0 | 6 | 1 | 10 |
| Control 2 | 30 | 70 | 0 | 6 | 2 | 10 |
| Inventive 1 | 30 | 0 | 70 | 6 | 2 | 10 |
| Inventive 2 | 30 | 0 | 70 | 6 | 3 | 10 |

The resulting base sheets were tested and exhibited the properties as shown below.

TABLE 3

| Code | GMT (g/3") | GM Slope (kg/3") | MD/CD Tensile Ratio | CD Tensile (g/3") | CD Stretch (%) | CD Slope (kg/3") | CD TEA (gf*cm/cm$^2$) | CD Durability Index |
|---|---|---|---|---|---|---|---|---|
| Control 1 | 770 | 4.32 | 2.17 | 522 | 5.72 | 9.64 | 2.34 | 14.61 |
| Control 2 | 898 | 5.31 | 2.12 | 618 | 5.71 | 11.01 | 2.79 | 17.21 |
| Inventive 1 | 706 | 3.79 | 1.75 | 535 | 7.43 | 8.19 | 3.25 | 20.69 |

TABLE 3-continued

| Code | GMT (g/3") | GM Slope (kg/3") | MD/CD Tensile Ratio | CD Tensile (g/3") | CD Stretch (%) | CD Slope (kg/3") | CD TEA (gf*cm/cm$^2$) | CD Durability Index |
|---|---|---|---|---|---|---|---|---|
| Inventive 2 | 778 | 3.94 | 1.90 | 565 | 7.91 | 8.24 | 3.58 | 21.40 |

To produce one-ply tissue product, the base sheets, produced above, were calendared using a steel-on-rubber roll combination (40 P&J hardness rubber roll) to a thickness of 6.6 mils±1.1 mil and the product wound into bath-tissue rolls of constant firmness, diameter and sheet count. The resulting one-ply tissue products were tested and exhibited the properties as shown in below.

TABLE 4

| Code | GMT (g/3") | MD/CD Tensile Ratio | CD Tensile (g/3") | CD Stretch (%) | CD TEA (gf*cm/cm2) | CD Slope (g/3") | CD Tear (gf) | Slough (mg) |
|---|---|---|---|---|---|---|---|---|
| Control 1 | 750 | 1.98 | 533 | 4.56 | 3.19 | 16.28 | 6.86 | 5.0 |
| Control 2 | 861 | 2.02 | 606 | 4.78 | 3.84 | 17.81 | 8.59 | 5.4 |
| Inventive 1 | 696 | 1.64 | 521 | 6.17 | 4.64 | 13.76 | 9.88 | 3.6 |
| Inventive 2 | 777 | 1.58 | 619 | 6.43 | 4.96 | 14.47 | 10.01 | 3.4 |

From this data, several CD-related parameters were calculated as shown in the table below.

TABLE 5

| Code | $\frac{100 \times \text{CD Tear (gf)}}{\text{CD Tensile (g/3")}}$ | $\frac{1000 \times \text{CD TEA (gf*cm/cm2)}}{\text{CD Tensile (g/3")}}$ | $\frac{100 \times \text{CD Stretch (\%)}}{\text{CD Tensile (g/3")}}$ |
|---|---|---|---|
| Control 1 | 1.29 | 5.98 | 0.86 |
| Control 2 | 1.42 | 6.34 | 0.79 |
| Inventive 1 | 1.90 | 8.91 | 1.18 |
| Inventive 2 | 1.62 | 8.01 | 1.04 |

As the table above illustrates, the inventive samples exhibited higher CD tear, higher CD TEA and higher CD stretch relative to CD tensile strength. Additionally, the inventive product had a low CD slope relative to CD tensile, indicative of a soft product.

What is claimed is:

1. A single ply wet-pressed tissue product comprising hardwood kraft pulp fibers having a curl index greater than about 0.20, the tissue product having a basis weight from about 16 to about 20 grams per square meter (gsm), a CD Tensile greater than about 450 g/3" and CD Stretch greater than about 6.0 percent.

2. The tissue product of claim 1 having a CD TEA greater than about 4.0 g*cm/cm$^2$.

3. The tissue product of claim 1 having a CD Stretch from about 6.0 to about 8.0 percent.

4. The tissue product of claim 1 having a slough less than about 4.0 mg.

5. The tissue product of claim 1 having CD Tear from about 8.0 to about 11.0 gf.

6. The tissue product of claim 1 consisting essentially of softwood and hardwood pulp fibers.

7. The tissue product of claim 6 wherein the product comprises from about 10 to about 50 percent hardwood kraft pulp fibers having a curl index greater than about 0.20 and from about 50 to about 90 percent softwood kraft fibers.

8. The tissue product of claim 1 having a CD Durability Index from about 18.0 to about 22.0.

9. The tissue product of claim 1 wherein the product is substantially free from non-wood fibers.

10. The tissue product of claim 1 wherein the single ply consists of a first and a second outer layer and a middle layer disposed there between, the first and the second outer layer comprising hardwood kraft pulp fibers having a curl index greater than about 0.20 and the middle layer consisting of conventional softwood kraft fibers.

11. The tissue product of claim 10 wherein the product comprises from about 10 to about 50 percent hardwood kraft pulp fibers having a curl index greater than about 0.20 and from about 50 to about 90 percent softwood kraft fibers.

12. The tissue product of claim 10 wherein the first and the second outer layers comprise hardwood kraft pulp fibers having a curl index from about 0.20 to about 0.30.

13. The tissue product of claim 10 wherein the first and the second outer layer comprise 100 percent, by weight of the layer, hardwood kraft pulp fibers having a curl index from about 0.20 to about 0.30.

* * * * *